US008161662B2

(12) United States Patent
Finke et al.

(10) Patent No.: US 8,161,662 B2
(45) Date of Patent: Apr. 24, 2012

(54) METHOD FOR OPERATING A LAUNDRY APPLIANCE HAVING A STEAM GENERATOR DEVICE, AND LAUNDRY APPLIANCE

(75) Inventors: Michael Finke, Hoevelhof (DE); Hartmut Linnemann, Rheda-Wiedenbrueck (DE); Robert Muether, Rheda-Wiedenbrueck (DE); Dirk Sieding, Luenen (DE)

(73) Assignee: Miele & Cie. KG, Guetersloh (DE)

( * ) Notice: Subject to any disclaimer, the term of this patent is extended or adjusted under 35 U.S.C. 154(b) by 981 days.

(21) Appl. No.: 12/140,536

(22) Filed: Jun. 17, 2008

(65) Prior Publication Data

US 2008/0313920 A1 Dec. 25, 2008

(30) Foreign Application Priority Data

Jun. 19, 2007 (DE) ..... 10 2007 028 618

(51) Int. Cl.
*F26B 7/00* (2006.01)
*B08B 3/00* (2006.01)

(52) U.S. Cl. ..... 34/380; 34/389; 34/517; 34/549; 34/565; 68/5 C

(58) Field of Classification Search ..... 34/380, 34/389, 524, 549, 565, 517; 68/5 C
See application file for complete search history.

(56) References Cited

U.S. PATENT DOCUMENTS

| | | | | |
|---|---|---|---|---|
| 4,027,630 | A * | 6/1977 | Giardini | 123/25 P |
| 2005/0087528 | A1* | 4/2005 | Kanzaki et al. | 219/682 |

FOREIGN PATENT DOCUMENTS

| | | |
|---|---|---|
| DE | 1017129 | 10/1957 |
| DE | 60006296 | 5/2004 |
| EP | 1026306 | 8/2000 |
| EP | 1464751 | 10/2004 |
| EP | 1655408 | 5/2006 |
| EP | 1659205 | 5/2006 |
| EP | 1813709 | 8/2007 |
| GB | 799788 | 8/1958 |
| WO | WO 2007/026989 A1 | 3/2007 |

* cited by examiner

*Primary Examiner* — Jiping Lu
(74) *Attorney, Agent, or Firm* — Leydig, Voit & Mayer, Ltd.

(57) ABSTRACT

A method for operating a laundry appliance including a housing having a substantially circular housing opening closable by a door, a substantially cylindrical container disposed within the housing and including a substantially circular container opening and configured to receive laundry for treatment. The laundry appliance also includes a steam generating device including a heating element, an inlet opening and an outlet opening for steam, and a nozzled disposed in a region of the container opening. The method includes activating the heating element until a temperature of the steam generating device reaches a predetermined upper limit. Water is introduced into a tank of the steam generating device at a predetermined flow rate and the temperature of the steam generator device is measured as the water is introduced. The flow rate of water is reduced when the temperature of the steam generator device drops below a lower limit. The flow rate of water is increased starting at a low value when the temperature of the steam generator device increases to a value above the lower limit and below the upper limit. The heating element is operated continuously at a predetermined power level.

18 Claims, 2 Drawing Sheets

METHOD FOR OPERATING A LAUNDRY APPLIANCE HAVING A STEAM GENERATOR DEVICE, AND LAUNDRY APPLIANCE

CROSS REFERENCE TO RELATED APPLICATIONS

Priority is claimed to German patent application DE 10 2007 028 618.1, filed Jun. 19, 2007, which is hereby incorporated by reference herein.

FIELD

The present invention relates to a method for operating a laundry appliance including a device for generating steam, and the laundry appliance.

BACKGROUND

For improved laundry treatment, in particular for post-treatment after washing, it is advantageous to steam the laundry in the washing machine so as to remove wrinkles.

European Patent Document EP 1 659 205 A2 describes a front-loading washing machine including a suds container for receiving wash liquid and the laundry to be treated. The washing machine also includes a steam generator which has a heating element and is capable of receiving the liquid to be evaporated, said heating element being provided for heating and evaporating the liquid. The washing machine further includes a means for spraying or introducing water into the suds container, the means including a nozzle in the edge region of the door opening. In order to generate the steam, the heating element is heated to a predetermined temperature of, for example, at least 100° C., after which the liquid is introduced into the steam generator. In this manner, steam is generated in the form of bursts. After a predetermined time, the flow of water into the steam generator is stopped. After another predetermined time, the inflow of water is reactivated. This activation and deactivation of the inflow of water is repeated several times.

European Patent Document EP 1 655 408 A1 describes a similar washing machine having a device for generating steam. This steam generator device has a temperature sensor for controlling the inflow of water. When the temperature drops below a predetermined value, the flow of water into the steam generator device is reduced. When the temperature exceeds the predetermined value, the inflow of water is increased.

Furthermore, European Patent Document EP 1 813 709 A2 describes controlling the water inflow and the heating element of a steam generator device as a function of a predetermined temperature value. Here, the operating time of the steam generator device is also taken into account.

European Patent Document EP 1 464 751 A1 describes a washing machine having a suds container for receiving wash liquid and the laundry to be treated. The washing machine described therein includes a steam generator used for steaming the laundry. Here, the steam generator includes a tank into which a predetermined amount of water is introduced. A heating element heats the liquid until it evaporates. The steam is passed through a conduit and a nozzle into the treatment chamber, i.e., into the interior of the drum. Moreover, water can be passed into the interior of the drum through the same conduit and nozzle. The inlet is directly connected to the water supply and is controlled by a valve. Similarly, a discharge valve controls the discharge of steam so as to provide sufficient steam pressure within the steam generator device. When the discharge valve is opened, a large quantity of steam is discharged because of the high pressure, as a result of which droplets are carried out of the tank. However, during treatment of laundry with steam, droplets are not desired because they result in non-uniform wetting of the laundry.

SUMMARY

In an embodiment, an aspect of the present invention is to provide an improved steam injection process in a laundry appliance having a steam generator device.

In an embodiment, the present invention provides a method for operating a laundry appliance. The laundry appliance includes a housing including a substantially circular housing opening closable by a door, a substantially cylindrical container disposed within the housing and including a substantially circular container opening and configured to receive laundry for treatment. The laundry appliance also includes a steam generating device including a heating element, an inlet opening and an outlet opening for steam, and a nozzled disposed in a region of the container opening. The method includes activating the heating element until a temperature of the steam generating device reaches a predetermined upper limit. Water is introduced into a tank of the steam generating device at a predetermined flow rate and the temperature of the steam generator device is measured as the water is introduced. The flow rate of water is reduced when the temperature of the steam generator device drops below a lower limit. The flow rate of water is increased starting at a low value when the temperature of the steam generator device increases to a value above the lower limit and below the upper limit. The heating element is operated continuously at a predetermined power level.

BRIEF DESCRIPTION OF THE DRAWINGS

An exemplary embodiment of the present invention will be described in more detail below and is shown in the drawings, in which.

DETAILED DESCRIPTION

Figure 1:
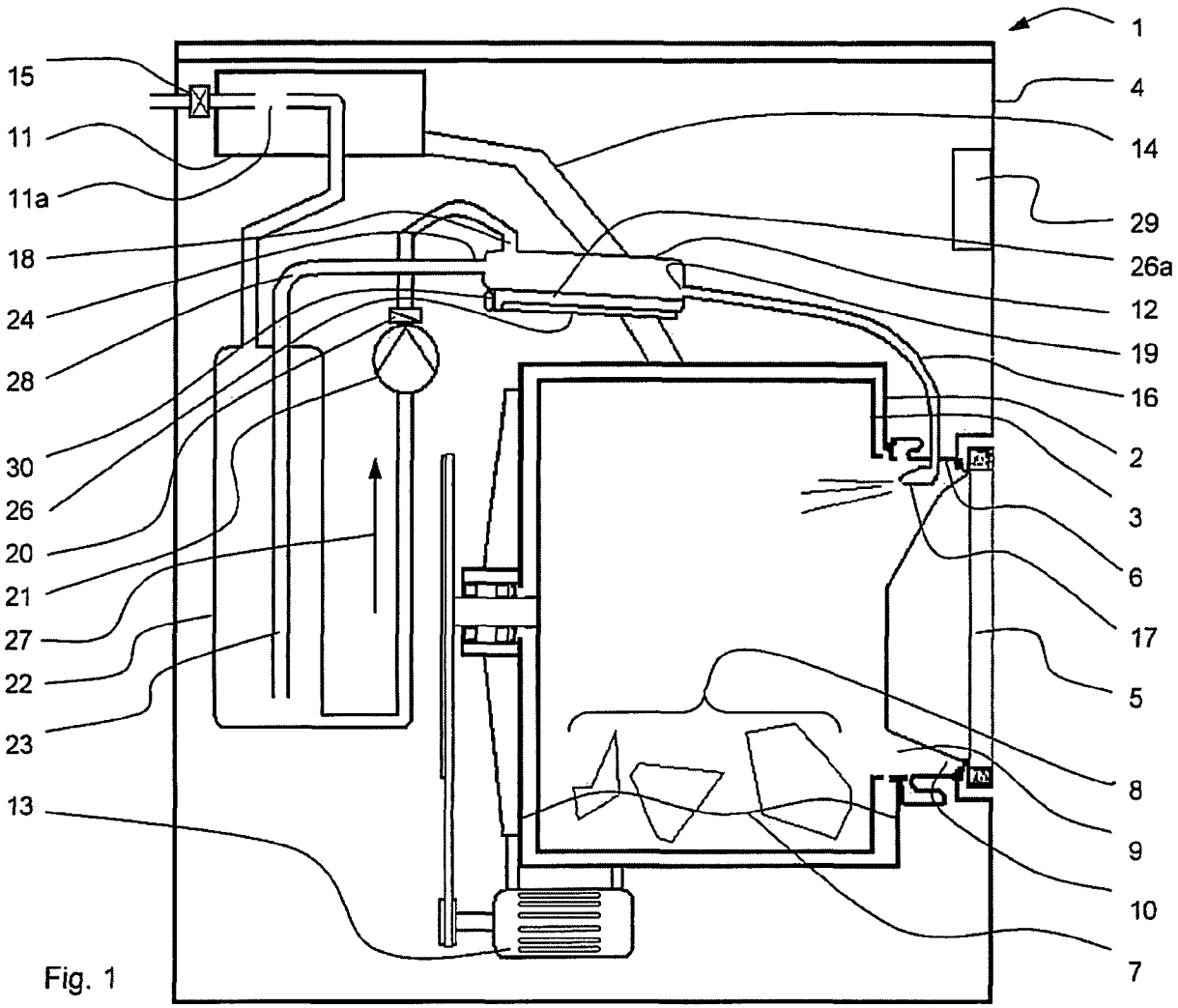
FIG. 1 is a schematic cross-sectional view of a laundry appliance having a steam generator device.

In an embodiment, the present invention relates to a laundry device, such as a washing machine, a washer-dryer machine, or a laundry dryer, including a housing, a substantially circular housing opening which is closable by a door, a substantially cylindrical container which is disposed within the housing and used for receiving the laundry to be treated and which has a substantially circular container opening, and further including a device used for generating steam and including a heating element, an inlet opening and an outlet opening for steam, the laundry appliance further including a nozzle disposed in the region of the container opening, the method including the steps of:

activating the heating element until the temperature reaches a predetermined upper limit, introducing water into the tank of the steam generator device at a predetermined flow rate.

In another embodiment, the present invention also relates to a laundry appliance, such as a washing machine, a washer-dryer machine, or a laundry dryer, including a housing, a substantially circular housing opening which is closable by a door, a substantially cylindrical container which is disposed within the housing and used for receiving the laundry to be treated and which has a substantially circular container opening, and further including a nozzle for injecting steam, and a device used for generating steam and including a heating element, a temperature measuring means, an inlet opening and an outlet opening for steam, the steam being injectable into the interior of the container through a nozzle disposed in the edge region of the container opening, the laundry appliance further including a controller for controlling the heating element and the water to be introduced into the steam generator device, the laundry appliance being suitable to carry out the method of the present invention.

The method of the present invention allows the steam to be generated in a predefined manner. For example, the steam may be introduced into the treatment chamber and onto the laundry to be treated in a substantially uniform manner or in bursts, as needed. Moreover, the heating element of the steam generator device can be operated at relatively low power ranging from 0.5 to 1.2 kW, while allowing for continuous inflow of steam throughout the duration of the steam treatment.

In accordance with an embodiment of the present invention, the method for operating the laundry appliance has the feature that the temperature of the steam generator device is measured and evaluated by the controller as water is introduced. During the heating and evaporation of the introduced water, the steam generator device cools down because the heating power of the heating element provides less heat output than that required by the introduced water to evaporate. When the temperature drops below a lower limit, the predetermined flow rate of the inflowing water is reduced, so that the steam generator device no longer continues to cool. Then, steam is generated from the smaller amount of water introduced. Thus, steam is generated in a continuous, modulated manner, which provides for a particularly uniform and gentle treatment of the laundry.

When using the steam generator device in a washing machine including a suds container resiliently mounted in the housing, a rotatable drum disposed in a horizontal or inclined position in said suds container, and having a substantially circular suds container opening, and further including a bellows seal disposed between the housing opening and the suds container opening to provide a connection therebetween, the nozzle for introducing water and injecting steam may be mounted in the bellows seal. This allows laundry to be uniformly and reliably treated with steam coming from the loading opening, particularly when the nozzle is mounted in the upper region of the sealing ring or of the loading opening of the drum. All directions are given relative to the laundry appliance in its upright position of use.

In an embodiment, the flow rate is reduced by a predetermined value in a step-like manner. A step-like reduction, for example, to about half the flow rate is easy to achieve.

In another embodiment, the flow rate is continuously reduced as a function of the temperature variation. This continuous reduction of the flow rate, as a result of which less water is introduced, allows for very accurate and fine adjustment of the steam volume.

When water is introduced at a lower flow rate, the steam generator device can heat up again. In this connection, when the temperature increases again to a value above the lower limit but below the upper limit, it the flow rate of the water to be introduced may be increased, starting at the low value. Thus, the heating element can be continuously operated at a predetermined power level, the temperature being controlled by varying the controllable flow rate of the water to be introduced.

The flow rate of the water to be introduced may be increased by a predetermined value in a step-like manner or continuously.

In an embodiment, the predetermined flow rate is 1.6 to 5 ml/sec, and the reduced flow rate is 0.3 to 1.5 ml/sec. With these flow rates, when the heating element is permanently energized at a power of, for example, 1 kW, the steam generator device will cool down when water flows in at the high rate, and the steam generator device will heat up when water flows in at the reduced rate.

The temperature limits may be selected such that the predetermined upper temperature limit is approximately 160° C. to 200° C., and that the lower limit is approximately 100° C. to 140° C. These values ensure that the steam is generated in a continuous manner, while preventing the formation of droplets to the greatest extent possible.

In the laundry appliance capable of carrying out the method described above, a pump may be used which can be controlled by the controller and used to deliver water to the steam generator device; the flow rate being able to be varied in the range of 0.3 to 5 ml/sec. This controlled pump enables water to flow in at rates at which it is continuously evaporated.

In an embodiment, the flow rate, which can be varied by the pump, can be adjusted by activating and deactivating the pump in a pulse-width modulated manner. This allows the flow rate of the inflowing water to be continuously varied, since the pulsating flow of water is attenuated to a continuous one by the inertia of the water in the conduit.

In another embodiment, water is introduced directly into the steam generator device through an inlet valve which can be controlled by the controller. In this case, the opening and closing of the inlet valve is controlled in a manner that allows the flow rate of the inflowing water to be varied in the range of 0.3 to 5 ml/sec.

In an embodiment, the inlet valve or the pump is designed such that the flow rate can be varied in a step-like manner or continuously.

In an embodiment, the steam generator device includes a mass for storing heat, said mass being heatable by the heating element. The mass is preferably sized to store approximately 5 kW of heat, so that even when the heating element provides a lower power, for example 0.5 to 1.2 kW, it is possible to generate a volume of steam which would normally require 5 kW. The mass may be provided by an aluminum block having a weight of 300 to 800 g. A block of aluminum can be optimally adapted or formed to hold the heating element, and the surface can provide direct thermal contact with the introduced water.

Another embodiment also uses an aluminum block having a weight of 300 to 800 g, but uses a heating element with a power higher than 1.2 kW, here, for example, about 1.3 to 2.1 kW. The higher heating power makes it possible to generate a larger amount of steam, or to heat up the steam generator device more quickly. This application requires a higher power supply.

FIG. 1 illustrates, in a schematic way, a laundry appliance 1, here a washing machine, having a suds container 2. Positions and directions are given relative to the laundry appliance in its upright position of use. A drum 3 driven by an electric motor 13 is rotatably mounted within suds container 2, said drum moving the laundry 8 present in suds container 2, i.e., in drum 3. In an embodiment, drum 3 is made of stainless steel and provided with a plurality of openings permitting flow therethrough. The wash liquid 7 or water required for the cleaning or treatment of laundry 8 is introduced in the lower portion of suds container 2. The warming or heating of liquid 7 is accomplished by a heating element disposed in the lower portion of suds container 2. An inlet valve 15 is indicated in the upper portion of appliance 1, the inlet valve controlling the inflow of water from the water supply system. Water is introduced into suds container 2 through dispensing compartment 11 and connecting tube 14. In the process, detergent which has been filled into dispensing compartment 11 is washed into suds container 2. In addition, laundry appliance 1 has a device 12 for generating steam which is injected into the interior of suds container 2, i.e., into the interior of drum 3, via a conduit 16 and a nozzle 17 connected thereto. Nozzle 17 is mounted in the upper region of a bellows seal 6 which provides the connection between opening 9 in suds container 2 and opening 10 in housing 4, which can be closed by door 5.

Laundry appliance 1 includes a pump 21 to deliver water 27 to the steam generator device 12, the pump having a check valve 20 provided on its pressure side for the water 27 to be pumped. The check valve prevents steam generated in steam generator device 12 from escaping through opening 18 and flowing back through pump 21.

Connected to outlet opening 19 is a conduit 16 through which the steam or water to be introduced is passed to nozzle 17. Nozzle 17 is mounted at the edge of opening 9 in the treatment chamber in the upper portion thereof, here in the region of bellows seal 6, and is directed toward the interior of suds container 2 so as to effectively spray steam onto laundry 8 present in suds container 2, i.e., in drum 3. A controller 29 controls the operations to be performed during a laundry treatment or wash cycle and during the generation of steam, such operations including, in particular, the control of inlet valve 15, of heating element 26, and of pump 21. In order to have more heat available than can be provided by heating element 26, steam generator device 12 includes an aluminum block 26*a* which interacts with heating element 26 as a heat-storing mass. The increased heat demand is needed especially at the beginning of the steam generation process in order to explosively produce a cloud of steam, after which the steam generation process evolves into a gentler, continuous steaming process.

Pump 21 draws the water 27 to be pumped from a tank 22, which is filled through the controllable inlet valve. In order to ensure compliance with hygiene requirements, a flow gap 11*a* is provided between inlet valve 15 and tank 22 in the area of dispensing compartment 11. Furthermore, a dip tube 23 is inserted in tank 22, said dip tube bypassing pump 21 and connecting via conduit 28 directly to a further inlet opening 24 of steam generator device 12. This bypass provides an overflow via which water flowing over from tank 22 is directed through dip tube 23 and connecting conduit 28 to steam generator device 12, and then through conduit 16 to nozzle 17, from where it is introduced into the interior of drum 3. Upon closure of inlet valve 15, a portion of water 27 flows out from the tank until it reaches the level of nozzle 17. In an embodiment, steam generator device 12 is mounted such that it slopes downward toward outlet opening 19, so that it is at least nearly completely emptied and thereby flushed, thus preventing, or at least reducing, the formation of lime and dirt deposits in steam generator device 12.

During steam generation, the dip tube prevents steam from escaping through further inlet opening 24; this arrangement acting as a siphon allowing steam to flow back into tank 22 in the event of excessive pressure. This arrangement provides a pressure relief valve which prevents excessive pressure in steam generator device 12.

Instead of a washing machine, the laundry appliance 1 used may also be a dryer which contains a rotatable drum 3, but in which there is no suds container 2 and no bellows seal 6. Here, nozzle 17 is disposed in the edge region of the housing opening to allow the steam to be injected into the interior of drum 3.

Figure 2:
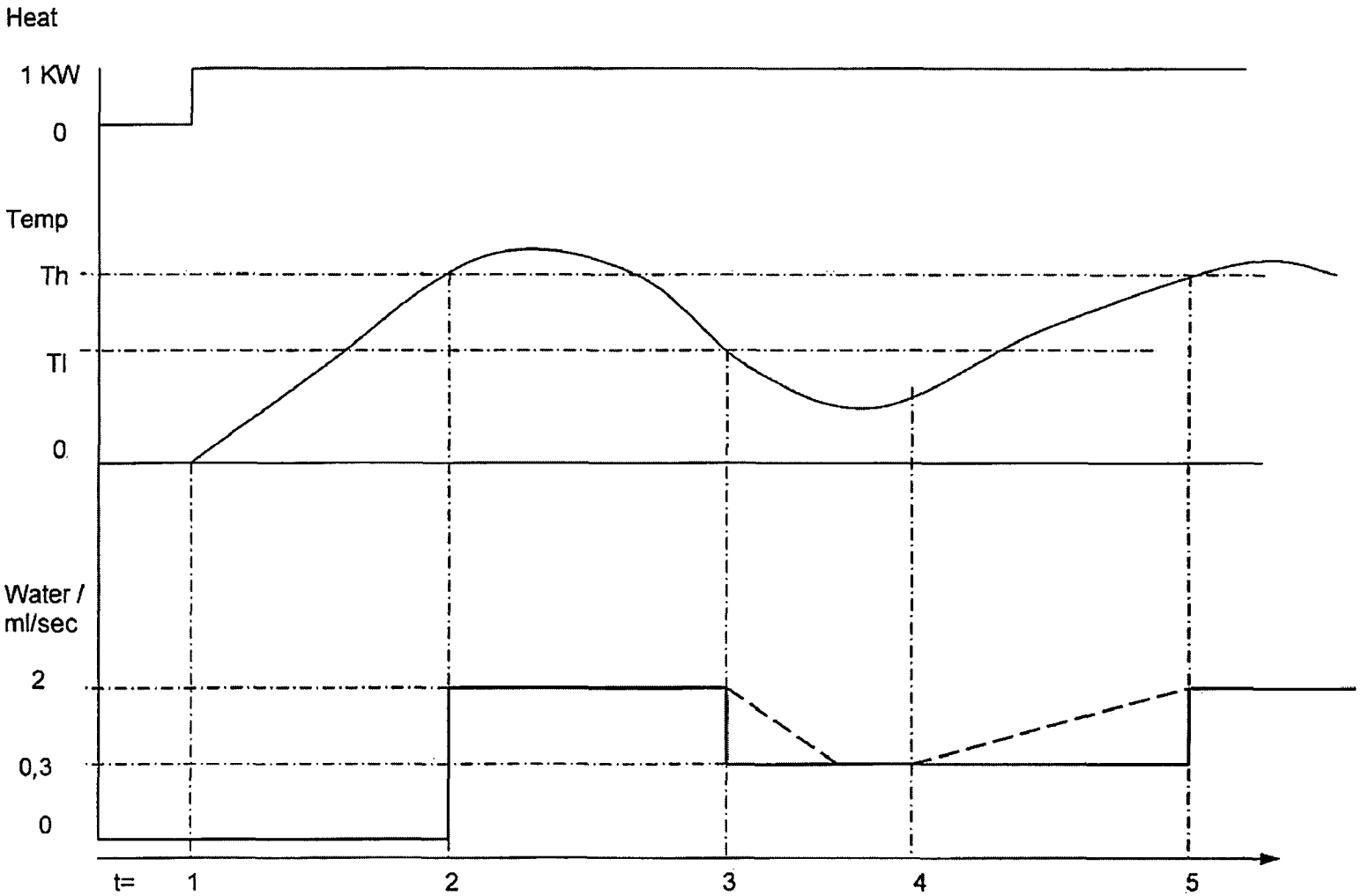
FIG. 2 shows the variation with time of the temperature, the water inflow, and of the heating activity.

FIG. 2 is a diagram showing the time profile for the steam generation process. At time t=1, the heating element (heat) is turned on. In this example, the heater converts a power of 1 kW into heat. The temperature curve Temp shows that the temperature increases continuously. Once the temperature reaches the upper limit Th, water is introduced into the steam generator device at a predetermined flow rate of, for example, 2 ml/sec. This occurs at time t=2. Due to the cooling caused by the inflowing water, the temperature flattens until the lower limit Tl is reached at time t=3. After lower limit Tl is reached, the inflow of water is reduced in a step-like manner, in this example to about a fraction, and thus reduced to a flow rate of 0.3 ml/sec. Alternatively, the inflow of water is reduced to the value of 0.3 ml/sec in a slowly decreasing manner, as shown by the dashed line. Then, the temperature no longer decreases at so high a rate until it increases again. If the introduction of water is controlled in a step-like manner, the inflow of water is adjusted to the predetermined value, here to 2 ml/sec, when upper limit Th is reached at time t=5. In an alternative embodiment, in which the inflow of water is changed continuously, the flow rate is continuously increased as shown by the dashed line once the temperature begins to increase again at time t=4. The process occurs repeatedly for as long as the steam injection is activated. The heating element remains energized during this period of time. The time intervals are not defined as absolute intervals here, because the control method used here is a temperature-dependent one. In the illustrated system, the heat-up time is about 10 to 30 seconds, and the period during which steam is generated from the large amount of water is about 4 to 10 seconds. In this example, the period during which steam is generated from the reduced amount of water is about 10 to 30 seconds. Different flow rates, or different, continuous variations of the flow rates, can also be used if it is advantageous for the laundry to be treated. The use of different flow rates, or different, continuous variations of the flow rates, or different heating powers, may accordingly result in different time intervals.

What is claimed is:

1. A method for operating a laundry appliance including a housing including a substantially circular housing opening closable by a door, a substantially cylindrical container disposed within the housing and including a substantially circular container opening and configured to receive laundry for treatment, a steam generating device including a heating element, an inlet opening and an outlet opening for steam, and a nozzle disposed in a region of the container opening, the method comprising:

activating the heating element until a temperature of the steam generating device reaches a predetermined upper limit in a range of 160° C. to 200° C.;

introducing water into a tank of the steam generating device at a predetermined flow rate in a range of 1.6 to 5 ml/sec;

measuring a temperature of the steam generating device as the water is introduced;

reducing a flow rate of the water to a reduced flow rate in a range of 0.3 to 1.5 ml/sec when the temperature of the steam generator device drops below a lower limit in a range of 100° C. to 140° C.;

increasing the flow rate of the water, starting at a low value, when the temperature of the steam generating device increases to a value above the lower limit and below the upper limit; and continuously operating the heating element at a predetermined power level.

2. The method for operating a laundry appliance as recited in claim 1, wherein the laundry appliance is one of a washing machine, a washer-dryer machine, and a laundry dryer.

3. The method for operating a laundry appliance as recited in claim 1, wherein the reducing is performed so as to reduce the flow rate by a predetermined value in a step-like manner.

4. The method for operating a laundry appliance as recited in claim 1, wherein the reducing is preformed so as to continuously reduce the flow rate as a function of the temperature variation.

5. The method for operating a laundry appliance as recited in claim 1, further comprising increasing the flow rate of the water by a predetermined value in a step-like manner in response to a further increase in temperature.

6. The method for operating a laundry appliance as recited in claim 1, further comprising increasing the flow rate of the water continuously in response to a further increase in temperature.

7. A laundry appliance comprising:

a housing;

a substantially circular housing opening closable by a door;

a substantially cylindrical container disposed within the housing and configured to receive the laundry to be treated, the container including a substantially circular container opening;

a nozzle disposed in an edge region of the container opening and configured to inject steam into an interior of the container;

a steam generating device including a heating element, a temperature measuring device, an inlet opening, and an outlet opening for steam; and a controller configured to operate so as to:

activate the heating element until a temperature of the steam generating device reaches a predetermined upper limit in a range of 160° C. to 200° C.;

introduce water into a tank of the steam generating device at a predetermined flow rate in a range of 1.6 to 5 ml/sec;

reduce a flow rate of the water to a reduced flow rate in a range of 0.3 to 1.5 ml/sec when a temperature of the steam generator device drops below a lower limit in a range of 100° C. to 140° C.;

increase the flow rate of the water, starting at a low value, when the temperature of the steam generator device increases to a value above the lower limit and below the upper limit; and continuously operate the heating element at a predetermined power level.

8. The laundry appliance as recited in claim 7, wherein the laundry appliance is one of a washing machine, a washer-dryer machine, and a laundry dryer.

9. The laundry appliance as recited in claim 7, further comprising a pump controlled by the controller configured to deliver water to the steam generator device, a flow rate of the pump being variable in the range of 0.3 to 5 ml/sec.

10. The laundry appliance as recited in claim 9, wherein the controller is configured to adjust the flow rate by activating and deactivating the pump in a pulse-width modulated manner.

11. The laundry appliance as recited in claim 9, wherein the controller is configured to vary the flow rate in a step-like manner.

12. The laundry appliance as recited in claim 9, wherein the controller is configured to vary the flow rate continuously.

13. The laundry appliance as recited in claim 7, further comprising an inlet valve controllable by the controller and configured to deliver water to the steam generator device; a flow rate through the inlet valve being controllable in a range of 0.3 to 5 ml/sec.

14. The laundry appliance as recited in claim 13, wherein the controller is configured to vary the flow rate in a step-like manner.

15. The laundry appliance as recited in claim 13, wherein the controller is configured to vary the flow rate continuously.

16. The laundry appliance as recited in claim 7, wherein the steam generator device includes a mass for storing heat, the mass being heatable by the heating element.

17. The laundry appliance as recited in claim 16, wherein the mass includes an aluminum block having a weight of 300 to 800 g, and the heating element includes a heating power of about 0.5 to 1.2 kW.

18. The laundry appliance as recited in claim 16, wherein the mass includes an aluminum block having a weight of 300 to 800 g, and the heating element includes a heating power of about 1.3 to 2.1 kW.

* * * * *